United States Patent [19]

Pecksen

[11] 3,956,988

[45] May 18, 1976

[54] POSITION-INDEPENDENT MINE CONSTRUCTION

[75] Inventor: Otto Pecksen, Bad Herrenalb, Germany

[73] Assignee: IndustrieWerke Karisruhe-Augsburg Aktiengesellschaft, Germany

[22] Filed: Jan. 29, 1973

[21] Appl. No.: 329,230

[30] Foreign Application Priority Data

Feb. 19, 1972 Germany ..... 2207840

[52] U.S. Cl. ..... 102/19.2; 102/4; 102/8; 102/24 HC

[51] Int. Cl.[2] ..... F42B 23/06; F42C 11/02

[58] Field of Search ..... 102/4, 7.2, 8, 56, 24 HC, 102/70.2 GA, 19.2

[56] References Cited

UNITED STATES PATENTS

| | | | |
|---|---|---|---|
| 2,857,842 | 10/1958 | Malm | 102/8 |
| 3,006,280 | 10/1961 | Rogers et al. | 102/70.2 GA |
| 3,061,248 | 10/1962 | Jones et al. | 102/4 X |
| 3,118,508 | 1/1964 | Friedman et al. | 102/24 HC |
| 3,397,640 | 8/1968 | Ziemba et al. | 102/79 |
| 3,575,110 | 4/1971 | Conroy | 102/8 |
| 3,592,148 | 7/1971 | Manis | 89/36 A |

*Primary Examiner*—David H. Brown
*Attorney, Agent, or Firm*—McGlew and Tuttle

[57] ABSTRACT

A position-independent dispersable land mine, in particular a hollow charge land mine for combatting wheeled or tracked vehicles, especially those which are armored includes an outer body which may be of a surface of revolution, such as a tube, and which carries an inner spherical member which is secured to the tube so that it is oriented in a fixed position in respect to the axis thereof. A second hollow spherical member is located inside the first hollow spherical member and it is faced away from the interior wall of the first spherical member by projecting elements which permits a relative rotation between the two spherical members. A hollow charge is contained within the interior of the inside second spherical member and it is mounted within a casing having a weight secured to one side so that the hollow liner of the hollow charge is oriented in a particular direction for example, such as that it extends normal to the axis of the tubular member. The mine is advantageously operated by a piezo-electric fuse which is also contained within the inner or second spherical member. The arrangement is such that the hollow charge is always maintained in a position such that it will be normal or perpendicular to the target.

9 Claims, 5 Drawing Figures

PRIOR ART

POSITION-INDEPENDENT MINE CONSTRUCTION

BACKGROUND OF THE INVENTION

This invention relates, in general, to the construction of hollow charges and, in particular, to a new and useful land mine for combatting, particularly armored vehicles, and which includes means for maintaining a hollow charge liner in a predetermined orientation when it is detonated.

DESCRIPTION OF THE PRIOR ART

Since a relatively high specific penetrating power is achieved with the use of hollow charge mines, they have proven to be specifically effective in the combatting of armored targets. The principle of operation of the hollow charge has been known for a long time. Max von Förster, as the first inventor, recognized in 1883 that hollowed explosive charges possess a greater destroying effect in comparison to smooth ones. A U.S. inventor, Munroe, proved experimentally in 1883 that the power emanating from an explosive charge is dependent on the exterior form of the charge and can be concentrated or oriented (directed) to a high degree, depending on the shape of the explosive by equal weight or volume, as, for example, cubes, spheres, cylinders or pointed cones. Thomanek discovered in 1938 the effect of metal inlays which are secured in the hollow of such explosive charges. Hensel researched these manifestations systematically, while Thomanek finally succeeded in illustrating the effect of hollow charges lined with metal by the use of X-ray flash radiography.

The hollow charge principle is based on the following phenomena:

Through the detonation of a metal armored inlay, an energy concentration occurs in the center of the hollow area and alongside the inlay. The conversion front of the explosive charge and the gas proceeds, in accordance with the speed of the detonation of the explosive which is used, having a speed of approximately 8,000 m/sec along the inlay material. The concentrated gas fumes follow the guided front beam which is a very rapid movement, but of small energy, and which has gas fumes which contain 30% of inlay material which has been formed into a liquid-gaseous form and this front beam has a pressure of several Mio kp/cm$^2$so that it quickly penetrates the resistance material of the target and perforates it. Thereby, the structure of the material is moved apart laterally so that the craterlike cambers occur in the target at the impact and exit sides. The inlay material which is now converted to a pestle or thorn, follows the gas fumes with a speed of up to 1,000 m/sec. The thorn remains stuck in the penetration duct if the wall material is too thick while a part of the gas fumes ineffectively puff away vertically up to the explosive surface area.

Through the use of hollow charges, objects capable of resistance, such as steel, stone, concrete, can easily be penetrated and this includes even armor plates of up to 1,000 mm in thickness. The diameter of the puncture, as well as the depth of the penetration, are influenced decisively by the form, strength, and kind of inlay material which is used. A bowl or half-spherical inlay or liner results in a greater puncture diameter but in a lesser penetration depth. A funnel-shaped inlay acts inversely, that is, it produces a small puncture diameter but a greater penetration depth.

Hollow charges are capable of being used in artillery grenades, rockets, gun grenades, anti-tank grenade launchers and in land mines, etc. For combatting of armored targets as well as wheeled and tracked vehicles, the use of so-called magnetic anti-tank hollow charges has been known for a long time. Such hollow charges have a penetration strength of about 200 mm and comprise substantially an explosive-filled hollow charge body, a tear-off fuse with a delay composition and several adhesive magnets.

For the combatting of armored vehicles, it is necessary that the magnetic charge be attached to the vehicle by means of permanent magnets and for the operator to activate the fuse and then to take cover. It is obvious that the use of such magnetic anti-tank hollow charges requires the courageous readiness accompanied by a high risk for the individual soldier. In order to combat the use of magnetic charges, it has been known to coat the exteriors of the tank with materials, such as a cement, which are not magnetically attractive in order to avoid the attachment of such charges.

SUMMARY OF THE INVENTION

The present invention provides a land mine having a hollow charge which is operated by the known piezo-electric effect for initiating the operation of the fuse to ignite the hollow charge and which is particularly adaptable for combatting operating wheeled vehicles or tracked vehicles, especially of armored construction and without endangering the soldiers using the equipment and without requiring magnetic attachment. The present invention also provides a mine construction which has relatively small dimensions and requires no entrenching or camouflaging in the ground and which, because of its relatively small weight, is not only transported by soldiers charged with the combatting of armored vehicles, but it is also capable of being dispatched in a dispersed manner from an airplane, for example, combat helicopters, etc., by means of rockets or other suitably constructed artillery granades.

The invention provides a charge construction which includes a body of revolutions, such as a tube, having a first hollow sphere on its interior which is secured to the tube in a fixed position. A second hollow sphere is mounted within the first sphere and is rotatable in respect thereto and it carries the hollow charge with a liner which is adapted to be positioned normal to the axis of the tube at all times. In order to achieve this orientation, the hollow charge casing carries a weight which causes the innermore second spherical member to be rotated back to a position in which the charge is normal to the axis of the tube whenever it is displaced from this position. The tubular body will approach the target vertically and, thus, the hollow charge liner will always be correctly oriented in respect to the target so that it will penetrate the wall thereof.

In the preferred form of the invention, the means for lining the hollow charge liner so that it will be in a correct position for engagement with the target comprises a weight which is carried in the lower end of the hollow charge casing. A disc-shaped transmission charge is advantageously located between the weight and the hollow charge. The weight is advantageously made of an annular form and it has a central portion which defines an area for receiving the piezo-electric fusing. The inner sphere is advantageously supported on the outer sphere by means of projecting elements which engage against the interior wall of the outer sphere and which may slide over the wall to permit relative rotation between the two spheres. The projecting elements advantageously comprise a shock-absorbing material, such as a synthetic material or rubber of appropriate hardness.

Preferably, the tubular body advantageously includes a portion extending above and below the spherical members and each extending portion is provided with perforations or recesses for facilitating the guidance of the charge to the target.

The charge constructed in accordance with the invention has the following advantages:

First, the external dimensions are relatively small. They do not exceed, in the preferred arrangement, a height and diameter of more than 100 mm. This results in a relatively light-weight construction of the mine and, consequently, it can be transported by a single soldier in addition to the usual weapons and equipment which is carried by an infantryman.

The application of the invention is not limited to use as an infantry weapon. When necessary, the mine may be launched by means of a carrier rocket in which the rocket advantageously includes a container for receiving a plurality of mines and which opens at a predeterminable height or distance over the target area. In addition, the inventive mines may be dispersed onto the ground by means of a thrust device which is mounted on a wheeled or tracked vehicle.

According to the characteristics of hollow charges, it is necessary, in order to produce the greatest effect, that the recess in the propelling charges, be always directed vertically in respect to the impact surface. Independently of the application chosen in each case, and of the position in space, the mine always directs itself with its propellant charge liner oriented completely normal to the vertical of the target surface. This automatic orientation, based on the known skip-jack principle, results in the mine becoming automatically settable by the cooperation of the resetting weight which is carried within the inner sphere coaxial to the hollow charges and also due to the weight of the transmission charge arranged below the equator plane of the inner sphere and which produces a rolling motion of the inner sphere relative to the outer sphere in order to correct the orientation of the hollow charge liner.

Because the weight is made of an annular shape, it leaves a space at the central lower portion of the charge casing for the fusing apparatus of the mine which advantageously works on the piezo-electric principle.

Because the outside body is provided with a plurality of recesses or perforations, both above and below the equator plane of the spheres, the charge is stabilized in the event that it is dropped from a helicopter or carrier rocket and, in addition, the rate of fall diminished.

The explosive charge itself preferably includes a degenerate hollow charge which is diminished so that when the hull of a tank is broken through, it causes a hole as great as possible to permit penetration of a relatively large charge thorn comprising an explosive and steel (of spherical and hollow charge inlays and liners, etc.). The hollow charge can be constructed in accordance with the nature of its use. Particularly useful is a construction by which fuel or machine oil can be ignited in order that the transported munition in the tank can be brought to detonation.

Accordingly, it is an object of the invention to provide an improved construction of hollow charge which includes a body of revolution having a first spherical member located therein and secured thereto and which carries an additional spherical member within the first spherical member which includes a hollow charge therein with a liner oriented normal to the axis of the outer spherical member and the body and with means carried by the inner spherical member for returning the inner spherical member to a position in which the liner is oriented normal to the axis of the body whenever it is moved away from this axis.

A further object of the invention is to provide a hollow charge liner which is simple in design, rugged in construction and economical to manufacture.

DESCRIPTION OF THE PRIOR ART

Figure 1:
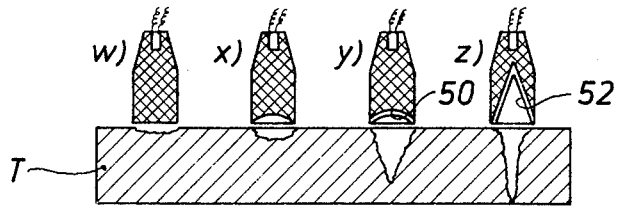
FIG. 1 is a schematic representation of the penetration effects of the known (prior art) hollow charges.

The prior art devices are shown in FIGS. 1 – 4 and, as indicated in FIG. 1, the effect of the known hollow charge constructed in the various shapes indicated at *w*, *x*, *y* and *z* are shown. The charge indicated at *w* comprises a smooth charge which has very small effect on the target surface designated T.

The charge indicated at *x* has a cavity, but does not include a metal inlay or liner and it does have some destroying and penetrating effect on the target which is greater than that shown by the construction *w*.

The hollow charge shown at *y* includes a metal inlay or liner 50 of a bowl-shaped configuration. The effect on the target T is twice as much as that shown by the hollow charge at *x*. A hollow charge liner of conical shape, such as the liner 52 shown in *z*, will have a very deep and narrow penetration, but the hole is smaller in diameter than that indicated at *y*.

Figure 2:
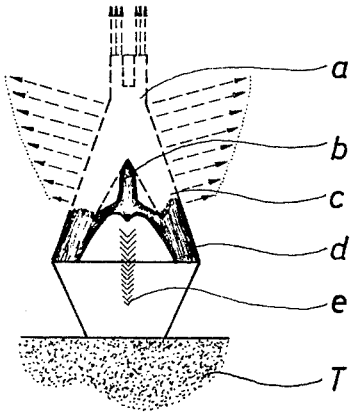
PRIOR ART Fig. 2
FIG. 2 is an enlarged view of the beginning of the detonation of a hollow charge construction of the prior art.
Figure 3:
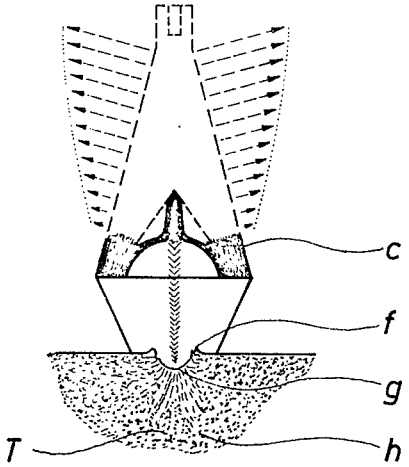
PRIOR ART Fig. 3
FIG. 3 is a more advanced view of the detonation of the prior art shown in FIG. 2.
Figure 4:
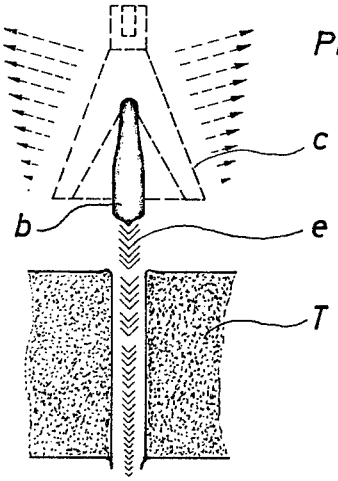
PRIOR ART Fig. 4
FIG. 4 is a still further advance view showing the charge at the detonation.

In FIGS. 2, 3 and 4, the detonation development of a known hollow charge is represented schematically. First, as shown in FIG. 2, the hollow charge at the beginning of detonation has a detonation front which progresses to the dotted line outlined at *c*. A part of the fumes a stream approximately perpendicular to the surface in an outward direction while another part flows under a pressure of about 100,000 kp/cm² into the compression zone behind the front at *c* and accelerates one after the other, or successively, at the individual zones of the lining body *d* in a direction radial to the axis. The upper zones are pressed against the upper part of the pestles or thorns *b* under separation of a beam-like part *e*, the following zones are still in the deformation phase.

In FIG. 3, which shows the hollow charge during detonation, the detonation front *c* has progressed further than that indicated in FIG. 2. The beam *e* grows longer until the point reaches the plate surface at *g*. The particles of the plate yield to the atmospheric pressure which here reaches a size of about 10 Mio kp/cm². This constructs a crater *f* corresponding to the line of force.

FIG. 4 indicates the hollow charge after detonation and here it can be seen clearly how the beam *e* has broken through the plate of the target T in a relatively sharp concentration.

A construction of the inventive hollow charge is chosen corresponding substantially, with certain modifications to the variant form shown at *y* in FIG. 1.

GENERAL DESCRIPTION OF THE PREFERRED EMBODIMENT

Figure 5:
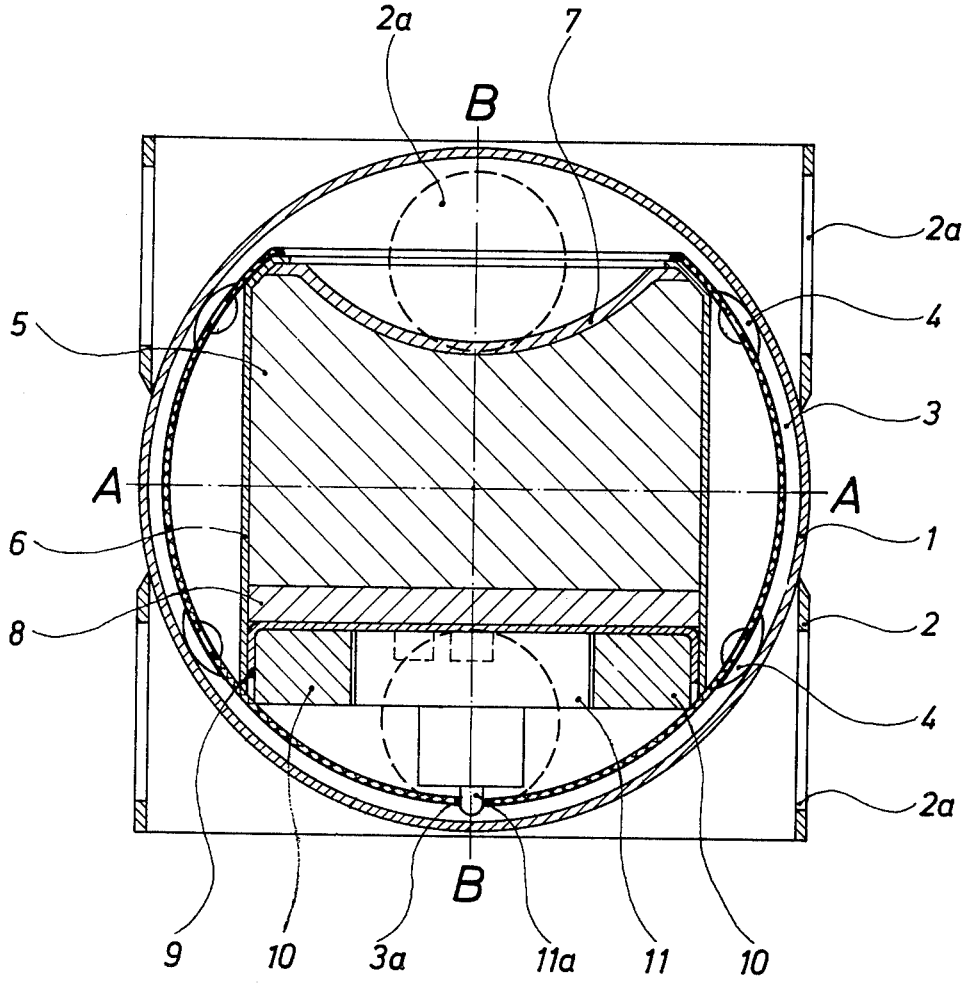
FIG. 5 is a vertical section of a hollow charge mine constructed in accordance with the invention.

Referring to FIG. 5, in particular, the invention embodied therein comprises a hollow charge which includes a first or outer sphere or spherical member 1 of a suitable sheet steel, or similar material, which is located within a revolution body or tube 2, preferably without the spherical member 1 exceeding the outer contour of the body 2. A spherical member 1 is secured to the tube 2 by suitable means such as spot-welding or gluing.

In accordance with the invention, a second hollow sphere or hollow spherical member 3 is located within the hollow sphere 1 and is maintained at a spaced location from the interior thereof by means of spacers or projecting elements 4 which are of a nature such as they permit the relative rolling movement of the inner spherical member 3 relative to the outer spherical member T. The spacers 4 have rounded outer surfaces which bear on the interior wall of the outer sphere 1 in gliding contact therewith.

A hollow charge 5 is arranged in a vessel or housing 6 within the inner spherical member 3. The hollow charge material is directed into the vessel 6 from its top in the direction of the axis B . . . B. For this purpose, the top part of the inner spherical member 3, in the shape of a spherical cap, is cut off. The hollow charge 5 includes a hollow charge liner or inlay of a steel or other similar material which increases the break-through force at the target.

Directly below the charge 5, there is located a transmission charge 8 which is preferably in the form of a disc, having a diameter corresponding to the diameter of the hollow charge 5. In addition, means for resetting the inner spherical member 3 in respect to the outer spherical member 1 and for positioning the hollow charge liner, such that it is normal to the axis B . . . B includes a weight 10 which is arranged directly adjacent the transmission charge 8 and which is carried in an annular pot-shaped vessel 9. A complete operating fuse including all of the associated parts for detonating the charges 8 and 5 are contained in a part which includes a base 11 which fits into the central area within the annular weight 10. The fuse comprises a piezo-electric operated igniter which includes a nose portion 11*a* which engages through a bore or opening 3*a* of the inner cylindrical member 3 so that it is positioned to extend downwardly toward the target when the device is dropped in the vertically oriented position shown in FIG. 5.

In accordance with a feature of the invention, the body 2 includes a plurality of peripherally arranged holes or recesses 2*a* which provide stabilizing control means to stabilize and diminish the rate of fall of the body when it is dropped from an aircraft, for example such as a helicopter or from a vessel arranged on a carrier rocket.

As described hereinbefore, in order obtain an optimal effect of a hollow charge, it is necessary that the cavity of the charge liner 7 be oriented so that the axis of the cavity is perpendicular to the target. With the inventive construction, the axis of the cavity of the hollow charge liner 7 and the axis of the hollow charge itself, will always automatically orient itself completely vertical to the target and this is irrespective of the position in which the hollow charge mine is dropped, that is, whether it is in the upright position shown in FIG. 5 or any position offset therefrom. This resetting or reorientation is caused primarily by the weight 10 which has a center of gravity which is located far below the equator plane A—A. The weight acts to cause rolling movement of the inner spherical member 3 relative to the outer spherical member 1 so that the hollow charge axis and the liner cavity axis move back to a vertical position after they are temporarily upset. The orientation of the hollow charge 5 is affected by the rolling capacity of the inner spherical member relative to the outer spherical member 1.

While a specific embodiment of the invention has been shown and described in detail to illustrate the application of the inventive principles, it will be understood that the invention may be embodied otherwise without departing from such principles.

What is claimed is:

1. A position-independent dispersable land mine, in particular a hollow charge mine for combatting wheeled and tracked vehicles, especially armored vehicles, comprising a body of revolution, a first closed hollow spherical member located within said body of revolution and secured thereto, a second hollow spherical member located within said first hollow spherical member, means supporting said second hollow spherical member for relative rotation in respect to said first hollow spherical member, a hollow charge mounted within said second hollow spherical member having a hollow charge cavity adapted to be oriented with its axis substantially vertically, and means in said second spherical member for maintaining said second spherical member with said hollow charge in a predetermined orientation in which said hollow charge cavity axis is substantially vertical.

2. A mine, according to claim 1, wherein said means for maintaining said second spherical member in predetermined orientation in respect to said first spherical member includes a weight carried in said second spherical member arranged coaxially to said hollow charge.

3. A mine, according to claim 1, wherein said means and second spherical member for maintaining said second spherical member in a predetermined orientation in respect to said first spherical member includes a retaining weight arranged coaxially to said hollow charge on the side thereof which is opposite to said hollow charge cavity and a transmission charge located between said weight and said hollow charge.

4. A mine, according to claim 1, wherein said means and second spherical member for maintaining said second spherical member in a predetermined orientation in respect to said first spherical member includes an annular weight arranged coaxially to said hollow charge and defining a central cavity therein, a piezoelectric fuse having a base portion disposed in said cavity and being connected to said transmission charge and said hollow charge for igniting said charges.

5. A mine, according to claim 1, wherein said support means comprise a plurality of spacer members carried by said second spherical member and projecting outwardly from the surface thereof and extend into rolling contact with said outer spherical member.

6. A mine, according to claim 5, wherein said spacers comprise a material having shock-absorbing characteristics.

7. A mine, according to claim 1, wherein said tubular body extends above and below said first spherical member and includes portions with a plurality of peripherally arranged perforations at each end of said first hollow spherical member.

8. A mine, according to claim 1, wherein said hollow charge includes a metal liner adjacent the cavity thereof, said body comprising a cylindrical tube extending outwardly from each side of said first hollow spherical member and having an intermediate opening through which the wall of the hollow spherical member projects, said hollow spherical member being of substantially the same diameter as the exterior diameter of said body, said inner spherical member having an opened top portion, said hollow charge cavity being oriented in opposed relationship to the open top portion and having a metal liner therealong.

9. A mine, according to claim 8, wherein said means in said second spherical member for maintaining said second spherical member in a predetermined orientation in respect to said first spherical member includes an annular weight having a central cavity, a fuse having a base portion arranged in said cavity and having a nose projecting through said second hollow spherical member and oriented along the axis of said hollow charge cavity but extending in a diametrically opposite direction.

* * * * *